US006148874A

United States Patent [19]

Rutter et al.

[11] Patent Number: 6,148,874

[45] **Date of Patent: *Nov. 21, 2000**

[54] FILLING HEAD MECHANISM THAT REMOVES MATERIAL FROM A SPOUT OF A FILLED CONTAINER BEFORE COMPLETELY DISENGAGING FROM THE SPOUT

[75] Inventors: Christopher C. Rutter, Oakland; Stanley E. Hurd, Pleasanton, both of Calif.

[73] Assignee: Packaging Systems, L.L.C., Romeoville, Ill.

[ * ] Notice: This patent is subject to a terminal disclaimer.

[21] Appl. No.: 09/144,719

[22] Filed: Sep. 1, 1998

Related U.S. Application Data

[63] Continuation-in-part of application No. 09/074,323, May 7, 1998.

[51] Int. Cl.[7] ..... B65B 1/04; B65B 3/04

[52] U.S. Cl. ..... 141/10; 141/90; 141/91; 141/114; 141/146; 141/250; 141/253; 141/258; 141/275; 141/313; 141/383

[58] Field of Search ..... 141/10, 90, 91, 141/98, 85, 114, 146, 250, 251, 253, 258, 275, 311 R, 369, 383, 386, 313; 222/148, 149; 53/167, 426

[56] References Cited

U.S. PATENT DOCUMENTS

| | | | |
|---|---|---|---|
| 3,874,430 | 4/1975 | Lansdale . | |
| 3,926,229 | 12/1975 | Scholle | 141/1 |
| 4,077,182 | 3/1978 | Papaluca | 53/109 |
| 4,120,134 | 10/1978 | Scholle . | |
| 4,417,607 | 11/1983 | Scholle et al. | 141/1 |
| 4,458,734 | 7/1984 | Scholle et al. | 141/5 |
| 4,832,096 | 5/1989 | Kohlbach | 141/114 |
| 4,893,659 | 1/1990 | Loliger | 141/85 |
| 4,991,633 | 2/1991 | Wong | 141/5 |
| 5,099,895 | 3/1992 | Loeliger | 141/89 |
| 5,301,714 | 4/1994 | Johnson | 137/599.2 |
| 5,474,113 | 12/1995 | Rademacher et al. | 141/31 |
| 5,479,955 | 1/1996 | Roodvoets et al. | 137/15 |
| 5,690,151 | 11/1997 | Rutter et al. | 141/92 |
| 5,865,221 | 2/1999 | Ludwig et al. | 141/31 |

FOREIGN PATENT DOCUMENTS 2389538 1/1979 France .

*Primary Examiner*—Henry J. Recla
*Assistant Examiner*—Timothy L. Maust
*Attorney, Agent, or Firm*—Majestic, Parsons, Siebert & Hsue

[57] ABSTRACT

A machine and method for filling bags with liquid through spouts attached to the bags, wherein a piston within a filling head that operates to control flow of the liquid from the filling head is also extended out of the filling head and into the spout, after the bag is filled, in order to push remaining material from the spout and through is bottom opening into the bag. The spout bottom opening is then closed, after which any remaining material adhering to the walls inside the spout and surfaces of the filling head are cleaned by forming a chamber between them through which a cleaning fluid is passed. This machine and method are particularly useful when filling bags with highly viscous and/or sticky liquids, such as thick food products. They avoid a result of having either to distribute messy bags of product with material remaining adhered to the outside of the spout and/or bag, or to first remove this material by an additional cleaning step.

9 Claims, 7 Drawing Sheets

FILLING HEAD MECHANISM THAT REMOVES MATERIAL FROM A SPOUT OF A FILLED CONTAINER BEFORE COMPLETELY DISENGAGING FROM THE SPOUT

CROSS-REFERENCE TO RELATED APPLICATION

This is a continuation-in-part of copending application Ser. No. 09/074,323, filed May 7, 1998, which application is incorporated herein in its entirety by this reference.

BACKGROUND OF THE INVENTION

This invention relates to machines that fill containers, such as plastic bags, with liquid material, such as food products, and, more specifically, to a filling head mechanism of such a machine and its cooperation with a container spout.

Many liquid or semi-liquid food products are distributed in bags of various sizes, typically carrying from one to six gallons of material. These bags are usually made of flexible plastic sheet material, with a rigid plastic spout attached. The bag is both filled and emptied through the spout. An advantage of this type of container over a rigid container is that, as product is removed through the spout, the bag collapses around the remaining product. This is a particular advantage with food products, since spoilage is retarded by minimizing contact of the bag contents with air. A wide variety of food products are carried in such containers, including soft drink syrups, and condiments, such as mayonnaise, catsup, and the like.

Machines used to fill such containers with product most commonly feed a long strip of empty bags to a bag separating station, then advance individual bags one at a time to a fill station, where they are filled with liquid product, and then move the filled bag out of the fill station. A bag is filled by coupling its spout with a filling head or nozzle, passing product through the filling head into the bag, and, after a valve in the filling head has stopped the flow of product, separating the bag spout from the filling head. A cap is usually then placed on the spout of the filled bag by snapping it in place, and the bag is then ready for shipping.

With such filling machines, it is difficult to avoid leaving some of the product in and around the spout of the filled bag, resulting in product remaining on the outside of the spout around the cap. Further, product often drips from the filling head onto the spout and outside of the bag itself as the filling head and bag spout are separated after filling. The resulting mess on the outside of the spout and bag is usually undesirable, particularly when the product is sticky, soft drink syrup being an example, or has a high viscosity, mayonnaise being an example. Distribution and use of such messy bags can be very unpleasant. Besides being sticky to the touch, the presence of food product on the outside of the container can develop an unpleasant odor and support the growth of bacteria. Others have sought to wash the filled bags to remove product from their outside but it is difficult to remove sticky and viscous materials from plastic surfaces.

Therefore, it is a primary object of the present invention to provide a filling machine, and a method of filling a container such as a bag, that avoids leaving product on the outside of the spout or container.

SUMMARY OF THE INVENTION

This and additional objects are realized by the present invention, wherein, briefly and generally, product is removed from both the container spout and filling head after the bag is filled but before the filling head and spout are separated from each other. This avoids product being left in and around the bag spout so as to spill onto the outside of the spout when it is capped, and avoids product dripping onto the outside of the spout and container, as the container spout and filling head are moved apart. This results in a filled container that has little or no product on its outside. The difficulties of having to ship and use a messy container, or in trying to clean it, are thus avoided.

According to a specific aspect of the present invention, product remaining in the container spout, after the filling head has been shut off, is pushed into the bag by a piston extending out of the filling head. This piston is, in a preferred embodiment, also a valve element that controls the flow of product out of the filling head. In addition to controlling the filling head flow, this piston has an outside shape and size that closely matches that of the interior of the container spout, thereby to push into the container most of the product left in the spout after filling.

According to another specific aspect of the present invention, any remaining product in the spout and any product adhering to the outside of the filling head and its piston valve are cleaned by positioning the filling head and spout to form a chamber between them through which a fluid, such as steam, air or an inert gas, flows to remove any remaining product from the interior of the spout and the filling head walls. A bottom of the spout is closed off from the product within the container before this cleaning begins. In a preferred embodiment, the filling head includes a first passage that carries the cleaning fluid from outside the filling head and into the chamber, and a second passage that carries the cleaning fluid from the chamber to outside of the filling head. The chamber is formed by moving the filling head and spout slightly from their filling position to expose these cleaning fluid passages but without completely separating them.

Each of these specific aspects of the present invention can advantageously be used without the other but the greatest benefit is obtained when they are used together.

Additional objects, advantages and features of the various aspects of the present invention will become apparent from the following description of a preferred embodiment, which description should be read in conjunction with the accompanying drawings.

DESCRIPTION OF A PREFERRED EMBODIMENT

Figure 1:
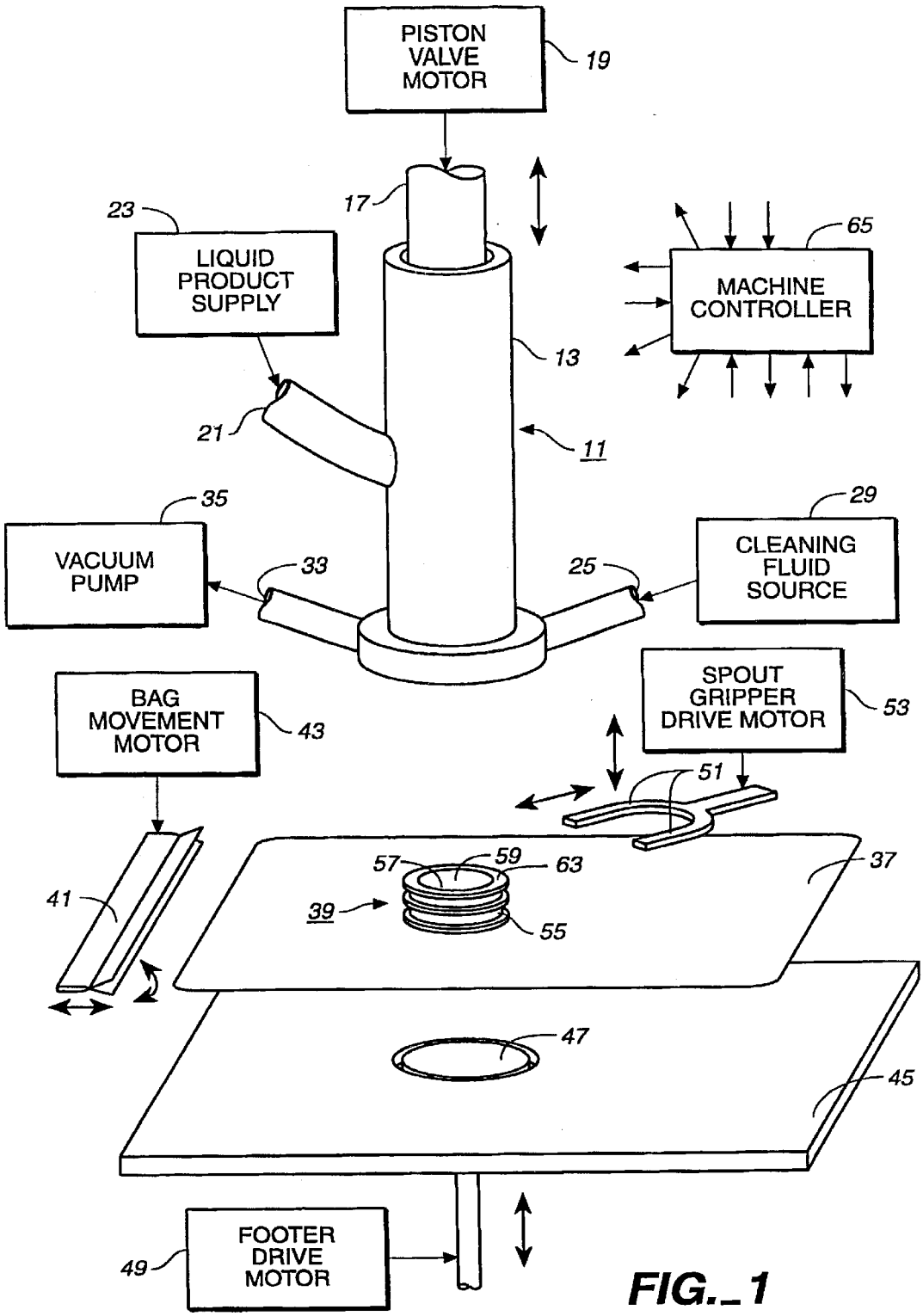
FIG. 1 is an isometric representation of an empty bag in a fill station that utilizes the specific aspects of the present invention.
Figure 2:
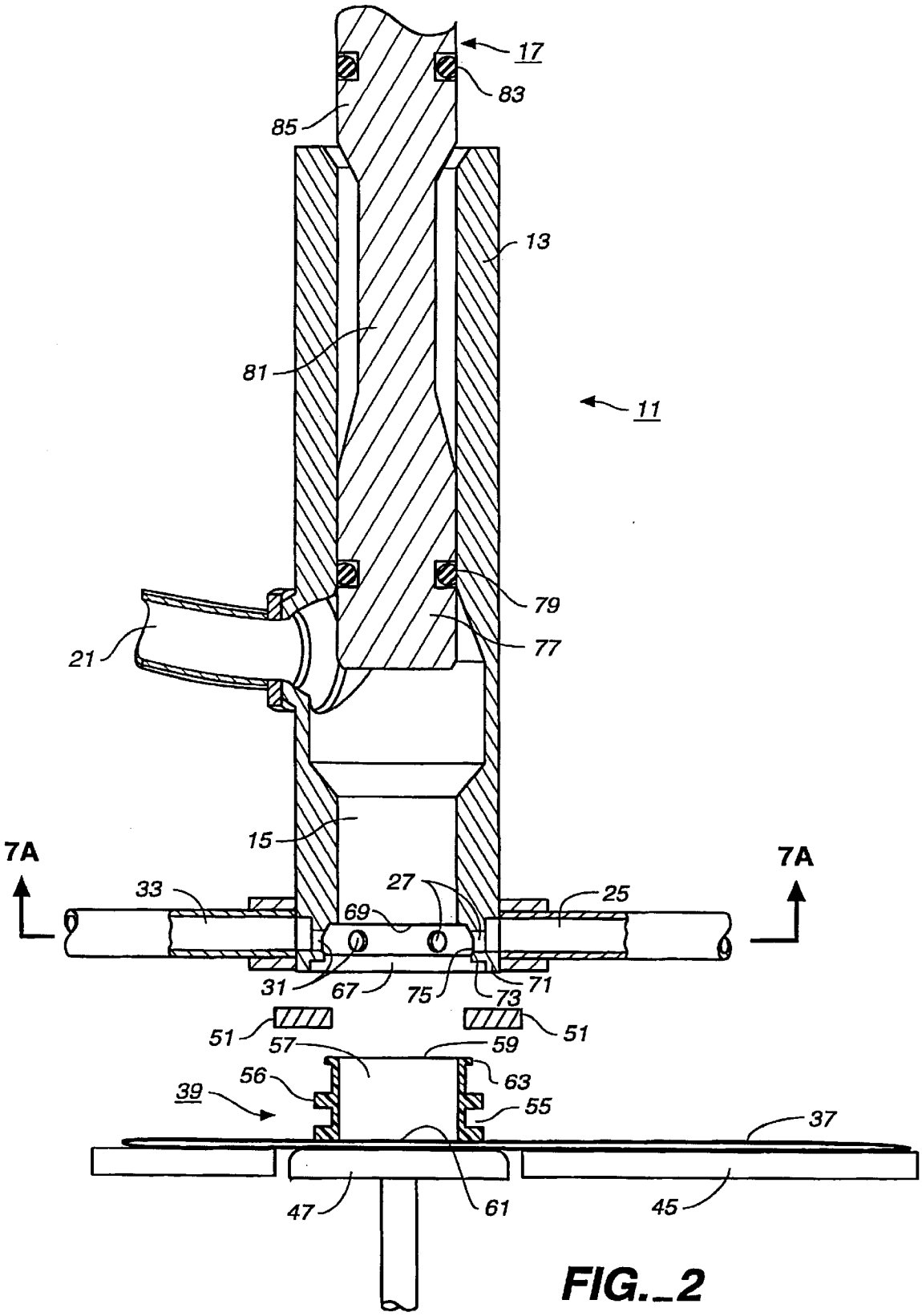
FIG. 2 is an elevational view of the fill station of FIG. 1 prior to filling the bag, a section of the filling head and bag spout being taken through their middle, being section A—A of FIGS. 7 and 7A.

An overall view of the fill station utilizing the various aspects of the present invention can be had by initially referring to FIGS. 1 and 2. A fill head assembly 11 includes a body 13 with a liquid passage 15 extending along its length. A piston valve 17 is moved within the passage 15 by a controlling motor 19. Liquid product to be packaged enters the passage 15 through an inlet 21 from a supply 23 of the product. Cleaning fluid enters an end of the filling head through a port 25 and openings 27 from a controlled supply 29 of cleaning fluid. The cleaning fluid is removed from the filling head end, as described in detail below, through openings 31 and a port 33 by a vacuum pump 35.

The type of container being filled by the mechanism of FIGS. 1 and 2 is a flexible plastic bag 37 with a rigid, cylindrically shaped spout 39 attached to one wall of the bag. Such a bag is normally separated from a large continuous stream of such bags in advance of reaching the fill station. A single bag is then usually pulled into position within the fill station by a bag gripper 41 that is operated by a controlled motor source 43. A table 45 supports at least some of the bag during part of filling operation. A footer 47 (also referred to as a "clamp pad") is movable by a motor source 49 from the rest position at the level of the table 45 shown in FIGS. 1 and 2 to a position above the table 45 against a bottom of a filled bag's spout, as described below.

The bag spout 39 is raised up to the filling head 11 and down again by a fork like element 51 that is moved by a controlled motor source 53. The fork 51 engages the spout 39 by fitting into an annular groove 55 formed on the outside of the spout by flanges on either side including an intermediate flange 56. The fill head assembly 11 is restrained against vertical movement, in this embodiment, but could alternatively be caused to move down to the bag spout 39. It will also be noted from FIG. 2 that the spout has an internal liquid passage 57 that is cylindrically shaped throughout its length from an open end 59 to a bottom end 61 that mates with an opening in one wall of the bag 37 to which the spout 39 is attached. The free spout end 59 contains a flange 63 with a circular outer edge. The motor sources schematically illustrated in FIG. 1 are controlled by a central machine controller 65. Position sensors (not shown) are also attached in a normal manner to the elements moved by the motors, in order to provide the controller 65 with position signals.

Figure 3:
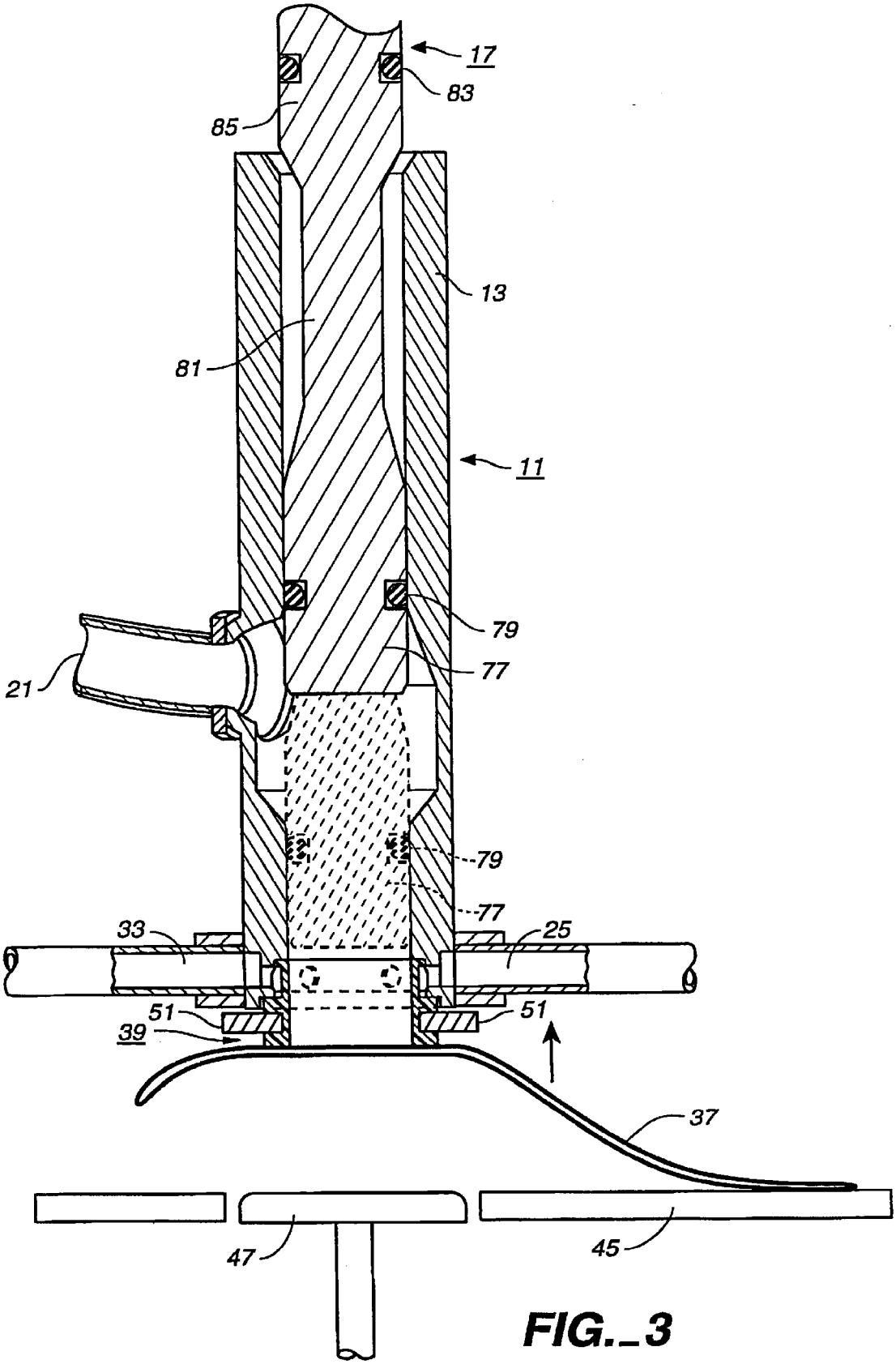
FIG. 3 provides the same view of the fill station of FIGS. 1 and 2 as shown in FIG. 2 but with its components positioned in a first stage of filling the bag.
Figure 4:
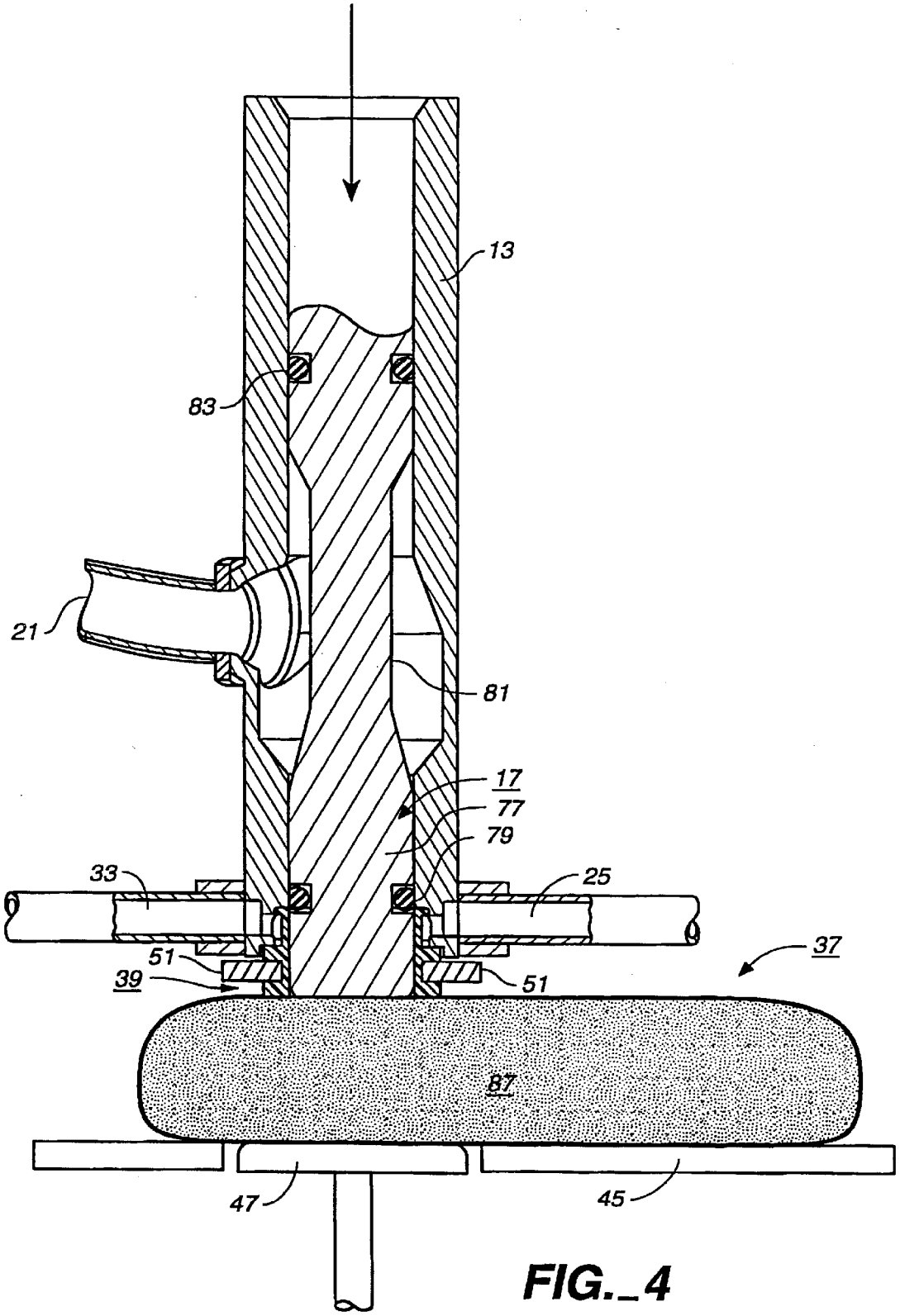
FIG. 4 provides the same view of the fill station of FIGS. 1 and 2 as shown in FIG. 2 but with its components positioned in a second stage of filling the bag.
Figure 5:
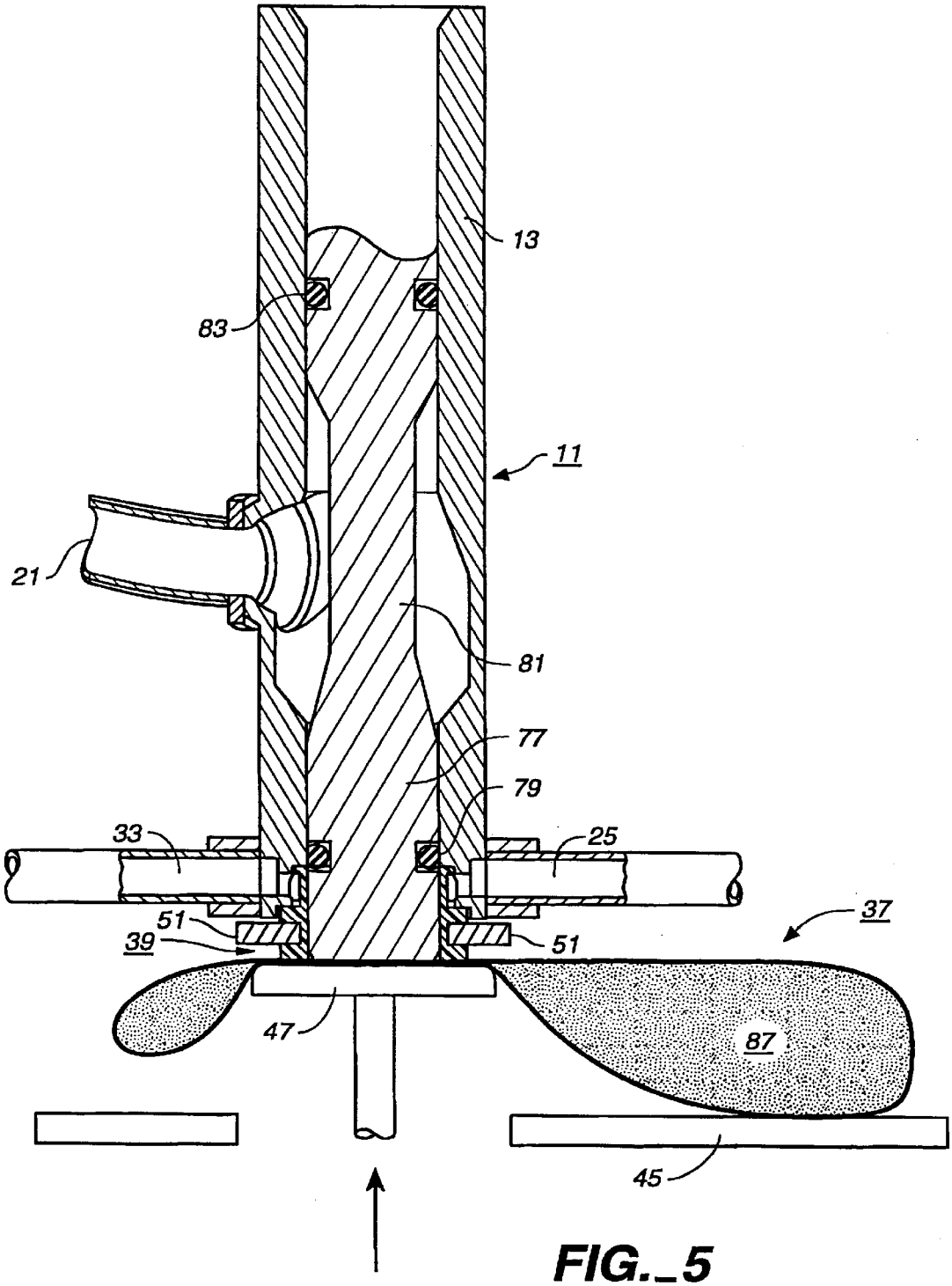
FIG. 5 provides the same view of the fill station of FIGS. 1 and 2 as shown in FIG. 2 but with its components positioned in a third stage of filling the bag.

The bottom end of the body 13 of the fill head assembly contains a circular receptacle 67 shaped to receive the open end 59 of the spout 39. A circular ledge 69 surrounds an end of the cylindrical fluid passage 15 and provides a seat for the spout flange 63 when the spout 39 is fully inserted into the receptacle 67. A shroud ring 71 attached at the bottom of the fill head assembly 11 includes an annular ring surface 73 against which the spout flange 56 abuts when the spout 39 is fully inserted into the receptacle 67. The spout 39 is illustrated to be so positioned in each of FIGS. 3, 4 and 5. The spout 39 is placed in this position in FIG. 3 to enable the bag 37 to be filled with product, as shown in FIG. 4. After the bag 37 is filled with product, any product remaining within the spout 39 is pushed into the bag, as shown in FIGS. 4 and 5 that are described below.

Figure 6:
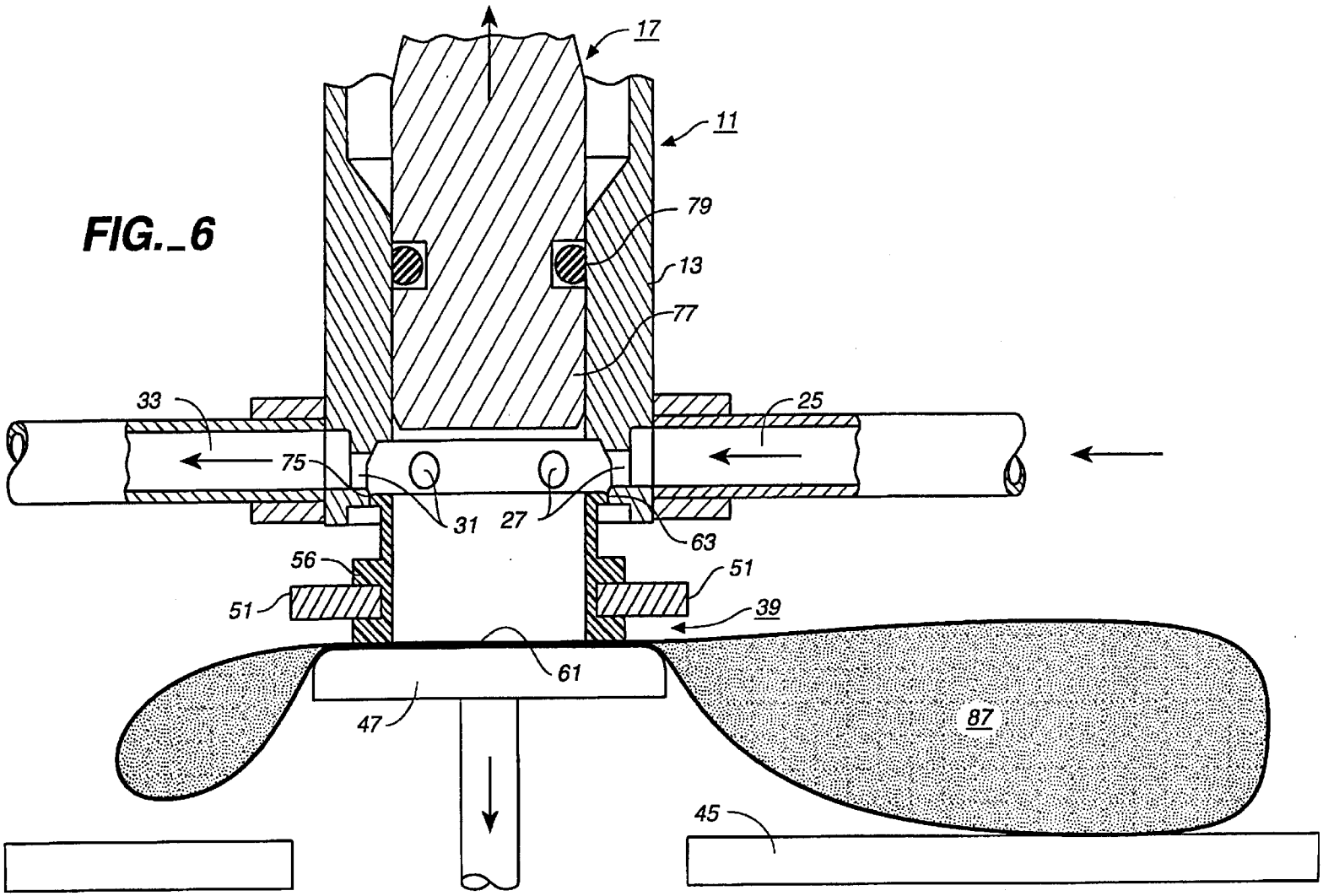
FIG. 6 provides the same view of the fill station of FIGS. 1 and 2 as shown in FIG. 2 but with its components positioned in a fourth stage of filling the bag.

The ring 71 has a circular opening 75 with substantially the same diameter as that of the outside edge of the spout end flange 63, large enough that the flange 63 can be easily passed through the opening 75 but small enough to block the flow of fluid therebetween when the flange 63 is stopped within the shroud opening 75. This latter position is shown in FIG. 6. Its function is to provide a chamber to contain a cleaning fluid after the bag 37 is filled with product, as described below.

The piston 17 has a cylindrically shaped end portion 77 that includes a resilient O-ring seal 79 which forms a fluid seal between the piston end 77 and an inside of certain portions of the length of the fluid passage within the filling head body 13. A reduced diameter portion 81 of the piston 17 allows liquid product to flow between it and the inside of the passage 15 when in certain positions therein. An O-ring seal 83 is provided on an enlarged portion 85 of the piston 17 that is on an opposite side of the reduced diameter portion 81 from the O-ring 79. The piston 17 is moved within the filling head body 13 by the motor source 19 between three primary operating positions of interest to this discussion: (1) a filling position (shown in FIGS. 2 and 3), wherein product is passed from the inlet 21 and through the spout 39 to fill the bag 37; (2) a displacement position (FIGS. 4 and 5), where the end 77 of the piston 17 has been pushed into the spout 39 to push product therein into the bag; and (3) a cleaning position (FIG. 6), where the end 77 of the piston has been pulled out of the spout 39 and slightly above the cleaning chamber 67. The O-ring 79 of the piston blocks product from flowing through the passage 15 of the filling head 11 when the piston 17 is in either of the displacement (FIGS. 4 and 5) or cleaning (FIG. 6) positions.

Operation of the filling mechanism embodiment will now be described in sequence. The single empty bag 37 is pulled across the table 45 of the fill station into the position illustrated in FIG. 2 by the bag gripper 41, a usual cap (not shown) on its spout 39 having been removed. The fork 51 is then inserted into the slot 55 on the outside of the spout 39, and raises the spout to the filling head 11 and into its receptacle 67 (shown in FIG. 3) with the spout flanges 63 and 56 contacting respective fill body annular surfaces 69 and 73. While all this is occurring, the piston valve 17 is in the position shown in dotted outline in FIG. 3, wherein product is blocked from passing out of the bottom of the filling head 11. Once the spout 39 is seated in the receptacle 67, however, the piston 17 is moved upward from its closed position (shown in dotted outline in FIG. 3) to its open position (shown in solid lines in FIG. 3). Liquid product then flows from the inlet 21, through the passage 15 within the valve body 13, and then through the interior 57 of the spout 39 into the bag 37.

After a metered amount of product has been placed into the bag, the piston 17 is moved to its closed position (dotted outline of FIG. 3), in order to stop the flow of product into the bag, and then further, in a single motion, to its displacement position shown in FIG. 4. The bag 37 has then been filled with product 87, and most of the product remaining in the interior 57 of the spout 39 has been pushed into the bag by the end 77 of the piston 17 moving through the spout interior 57 to the spout end 61 that opens into the interior of the bag. This displacement action is particularly useful when the product is a thick or highly viscous liquid, to clean most of it out of the spout before terminating the filling operation.

The piston end 77 has a cylindrically shaped surface with a uniform diameter that is substantially the same as the inside diameter of the passage 57 of the bag spout 39 but sufficiently less to allow easy insertion and withdrawal of the piston in the passage 57. The O-ring 79 is positioned a distance from the end of the piston portion 77 so that it seals with sidewalls of the passage 15 above the cleaning openings 27 and 31 when the piston is fully extended into the spout 37, as shown in FIGS. 4 and 5. This also keeps the filling head turned off to dispensing product through the spout into the bag.

After the step illustrated in FIG. 4, the footer 47 is moved upward to urge the bottom layer of the filled bag 37 against the bottom of the spout 39, as shown in FIG. 5. Liquid product 87 moves within the bag when this occurs, as illustrated. The bottom opening 61 of the spout 39 is thus closed off. The reason for doing so is to permit cleaning product from surfaces with a cleaning fluid without the cleaning fluid entering the filled bag. The cleaning has two effects. One is to remove any product adhering to the inside walls of the spout, especially adjacent the spout top 59, prior to a cap being placed on the spout for shipping. The cleaning prevents product spilling from the inside of the spout over onto its outside surface as the cap is applied. Another reason for the cleaning is to remove product from adhering to the end of the piston 17, shroud ring 71 and other surfaces at the end of the fill head assembly 11 to which product may be adhered. This prevents product dripping from such surfaces as the fill head assembly 11 and spout 39 are separated from each other after the bag is filled. The result is a filled, capped bag without product undesirably having been spilled on its outside.

This cleaning is accomplished by first forming a cleaning chamber within the fill head receptacle 67 by withdrawing the position 17 into the passage 15 but keeping it closed to product flow out of the bottom of the fill head, lowering the spout 39 slightly with the fork 51, and lowering the footer 47 the same amount as the spout, these new positions being illustrated in FIG. 6. The spout 39 is lowered until the outer edge of its top flange 39 is even with the inside surface 75 of the fill head bottom ring 71. FIG. 6 shows this new position. The spout is then moved away from blocking the cleaning fluid input and output openings 27 and 31. In addition, alignment of the top spout flange 63 and the shroud ring 71 encloses the cleaning chamber at its bottom. The mating of the spout flanges 63 and ring 71 inside surface 73 need not be fluid tight since the vacuum pump 35 prevents any significant loss of cleaning fluid therebetween.

Figure 7:
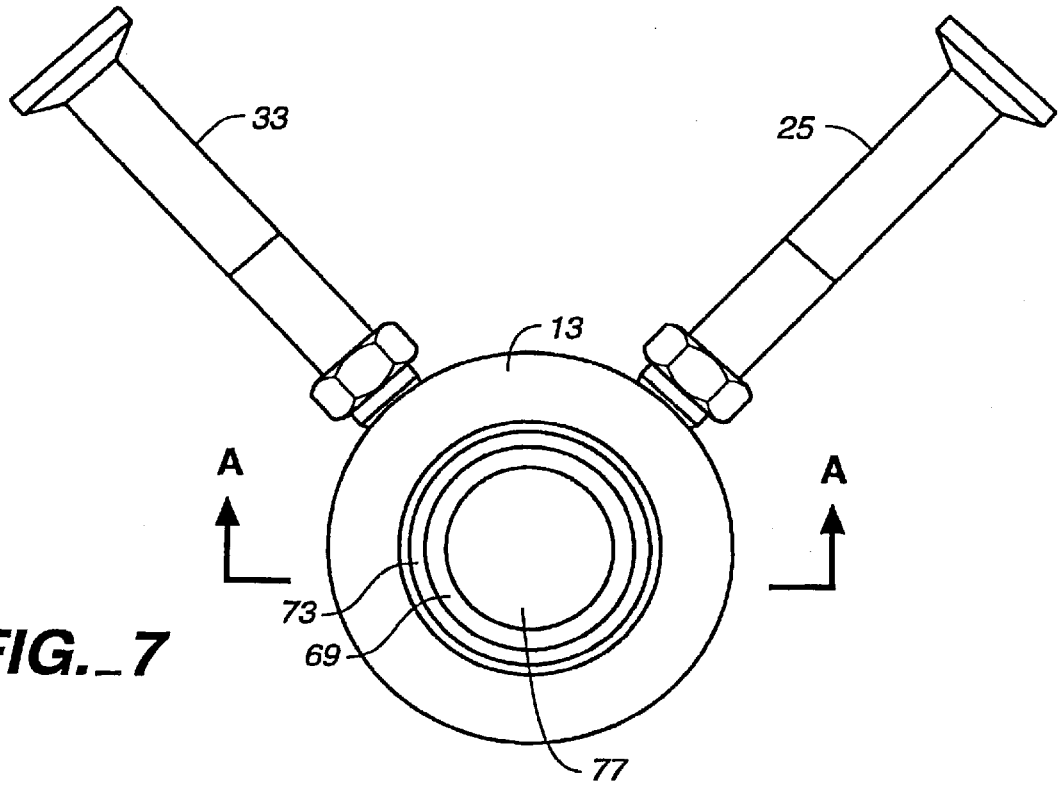
FIG. 7 is a view of the filling head of FIGS. 1–6, looking upward from its underside.
Figure 7A:
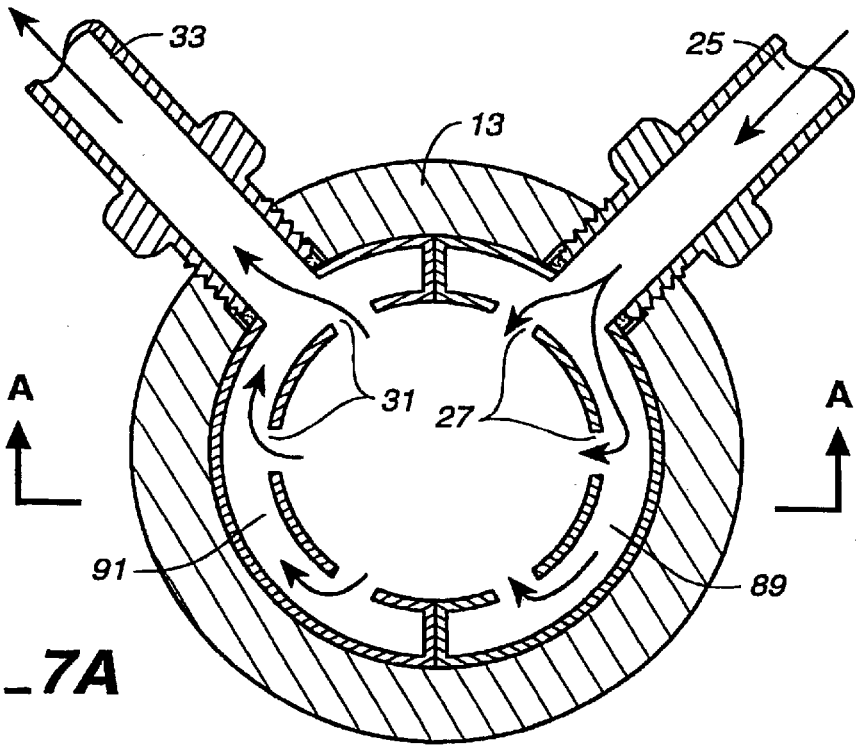
FIG. 7A is the same view of the filling head as shown in FIG. 7 but taken at a section 7A—7A of FIG. 2.

Cleaning fluid is then passed through the chamber from the source 29, through the passage 25 to a plenum 89 (FIG. 7A), into the chamber through openings 27, out of the chamber through openings 31 into a plenum 91 (FIG. 7A), through the passage 33 and then discharged through the vacuum pump. Various types of cleaning fluid may be used, depending primarily upon the characteristics of the product being filled into the bags. Such a fluid is usually selected from plain water or other liquid, or steam or other vapor, or an inert or other type of gas. The fluid washes the inside surface and top of the spout 63, as well as the end of the piston 17 and other surfaces of the fill head 11 that are exposed to form the cleaning chamber within the receptacle.

The filled bag is then capped and is ready to ship to the ultimate purchaser of the product it contains. After the filled bag is moved out of the fill station by the bag gripper 41, a fresh empty bag is moved into place and the filling process begins again.

Although the bag spout is shown to be closed after filling by moving the footer 47 into the position shown in FIG. 5, other valving techniques could alternatively be used. For example, a valve structure can be included in the spout itself. This, of course, adds expense to the spout and bag, so the disclosed embodiment is preferred since no valving structure need be included in the spout 39 in order to carry out the cleaning operation. A dispensing valve may be included, however, if desired for ease of use by the ultimate customer.

The description above assumes that the supply 21 of product through the fill head 11 is turned on and off with movement of the piston valve 17. If the valve 17 is moved rapidly in doing so, however, it is usually preferred to maintain a flow of liquid through the filling head 11 even when not discharging product into a bag. This is done by diverting product out of a recirculation exit port (not shown) provided through the body 13 at a position sightly higher than the input port 21, when the valve is closed to discharging product to a bag spout. Such an exit port is blocked off when the piston 17 is in the position shown in FIGS. 2 and 3 (solid outline), where product is being discharged from the inlet 21 and through the filling head passage 15. The exit port is unblocked when the piston valve 17 is in one of the positions shown in FIGS. 3 (dashed outline), 4, 5 and 6. In these latter valve positions, product continues to enter the fill head 11 through the port 21, flows passed the piston member's reduced diameter portion 81, and then out of the exit port. Th exited product is returned to the supply 23. Large forces that can be created by rapid closing of a valve are significantly reduced by providing such recirculation.

Although the various aspects of the present invention have been described with respect to a preferred embodiment thereof, it will be understood that the invention is entitled to protection within the full scope of the appended claims.

It is claimed:

1. A method of filling a flexible bag with liquid material through an open end of a rigid attached spout, comprising:

abutting a filling head against the open end of the spout in a manner that a passage within the spout is aligned with a liquid passage within the filling head, opening the filling head passage to allow liquid material to flow under pressure therefrom through the spout passage and into the bag, closing the filling head passage to liquid flow after the bag is filled with the liquid material, thereafter forcing liquid material remaining in the spout passage into the bag through a bottom opening of the spout, thereafter closing off the bottom opening of the spout to the flow of liquid material between the spout passage and the bag, and thereafter removing liquid material remaining in the spout passage through the open end of the spout.

2. The method according to claim 1, wherein forcing liquid material remaining in the spout passage into the bag includes forcing a solid piston through the spout passage from the open end toward the bottom opening of the spout, wherein an outside dimension of the piston is substantially the same as an inside dimension of the spout passage but able to move with respect thereto.

3. The method according to claim 2, wherein the opening and closing of the filling head passage to liquid flow includes moving said piston within the filling head passage between opened and closed positions.

4. The method according to claim 1, wherein closing off the bottom opening of the spout includes urging, from outside of the bag, an area of the bag opposite the spout against the bottom of the spout.

5. The method according to claim 1, additionally comprising, simultaneously with removing liquid material remaining in the spout passage, removing liquid material remaining adhered to the filling head after the bag is filled.

6. The method according to claim 5, wherein removal of liquid material remaining in the spout passage and adhered to the filling head after the bag is filled includes:

forming a chamber between the spout open end and the filling head, and passing cleaning fluid through the chamber and spout passage.

7. The method according to claim 6, wherein the cleaning fluid consists of a liquid.

8. The method according to claim 6, wherein the cleaning fluid consists of a vapor.

9. The method according to claim 6, wherein the cleaning fluid consists of a gas.

* * * * *